US005421112A

United States Patent [19]

Knorr

[11] Patent Number: 5,421,112

[45] Date of Patent: Jun. 6, 1995

[54] MODULAR DISPLAY ASSEMBLY

[75] Inventor: Herbert R. Knorr, Toronto, Canada

[73] Assignee: Fedor Expositions Inc., Montreal, Canada

[21] Appl. No.: 212,712

[22] Filed: Mar. 14, 1994

[51] Int. Cl.[6] ..... G09F 7/04

[52] U.S. Cl. ..... 40/600; 52/71; 52/DIG. 4; 40/606; 40/611; 160/135

[58] Field of Search ..... 52/71, 637; 211/189; 40/308, 312, 584, 600, 605, 606, 611; 160/135, 351

[56] References Cited

U.S. PATENT DOCUMENTS

| | | |
|---|---|---|
| 3,102,314 | 9/1963 | Alderfer . |
| 3,537,200 | 11/1970 | Bubb . |
| 3,965,599 | 6/1976 | Ebner . |
| 3,987,567 | 10/1976 | Fritts . |
| 4,078,664 | 3/1978 | McConnell . |
| 4,642,926 | 2/1987 | Friedman . |
| 4,657,149 | 4/1987 | Masson . |
| 4,722,146 | 2/1988 | Kemeny . |
| 4,912,866 | 4/1990 | Bannister et al. . |
| 4,976,055 | 12/1990 | Kane . |
| 4,977,696 | 12/1990 | Johansson . |
| 5,024,015 | 6/1991 | Quarles, Jr. . |

FOREIGN PATENT DOCUMENTS

| | | |
|---|---|---|
| 2035718 | 1/1972 | Germany . |
| 3538293 | 4/1987 | Germany . |

*Primary Examiner*—Carl D. Friedman

*Assistant Examiner*—Yvonne Horton-Richardson

*Attorney, Agent, or Firm*—Bacon & Thomas

[57] ABSTRACT

A very simple yet efficient and versatile display assembly made of a plurality of lightweight modular units that are easy to store, transport and assemble. The assembly has one or more lower frame units made of structural profile members connected to each other so as to form a lower front panel and a pair of lower side panels hingedly connected to the lower front panel on both sides thereof, respectively. The assembly also has one or more upper frame unit made of structural profile members similar to those of the lower frame unit and connected to each other in the same way so as to form an upper front panel of the same length as the lower front panel and a pair of upper side panels having lower ends of the same width as the upper ends of the lower side panels, the upper side panels being hingedly connected to the lower from panel on both sides thereof, respectively. Connection rods are provided for detachably connecting the upper frame units on top of the lower frame units, with the upper front and side panels extending in the same planes as the lower front and side panels, respectively. The assembly further has a plurality of covering panels detachably fixable preferably with magnetic strips onto the respective upper and lower, front and side panels. Straddle clips may be used to connect laterally adjacent frame units to each other. The assembly may further have, if desired, one or more table frame units and one or more lamps hookable on top of the upper frame units.

15 Claims, 11 Drawing Sheets

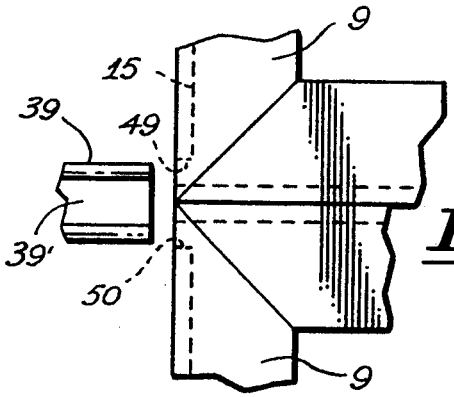
Fig. 10b
Fig. 10a
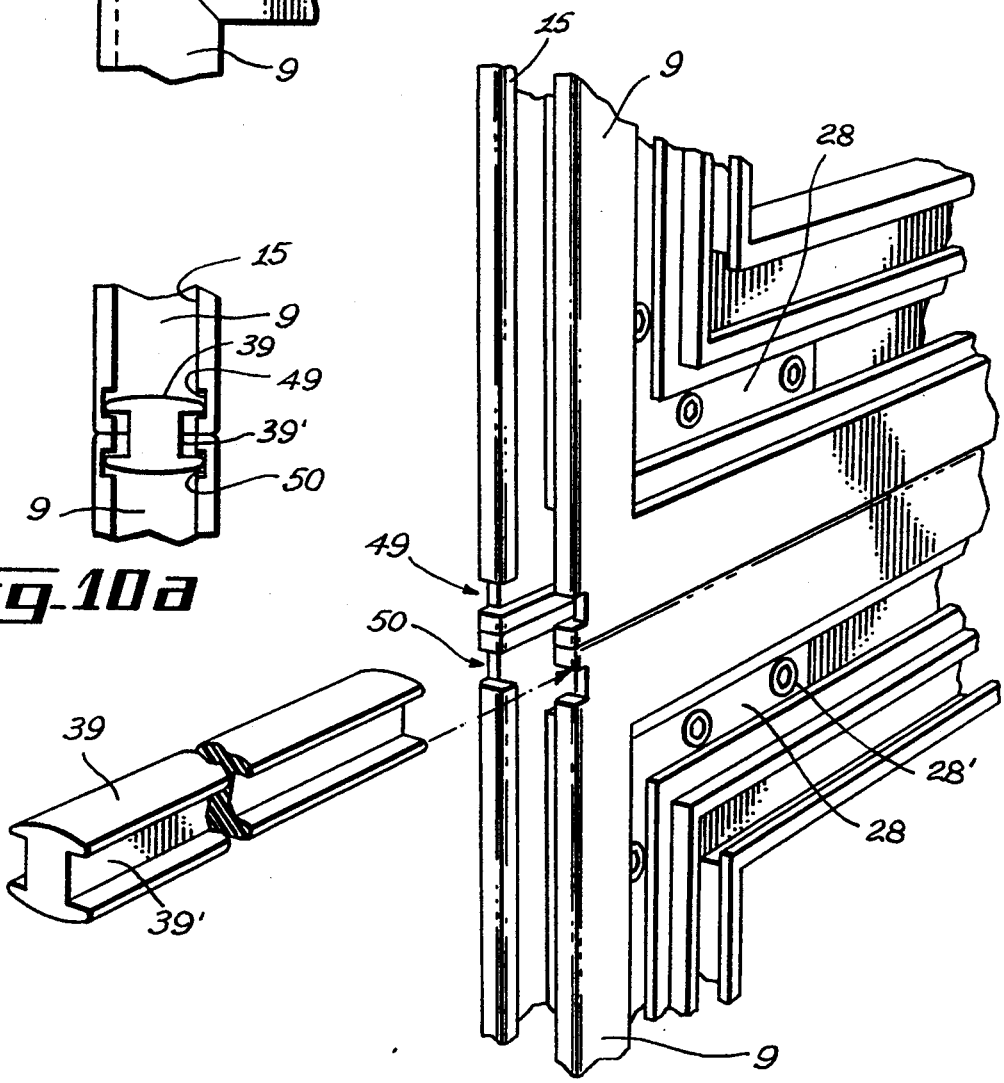
Fig. 10

MODULAR DISPLAY ASSEMBLY

BACKGROUND OF THE INVENTION a) Field of the Invention

The present invention relates to a modular display assembly made of a plurality of frame units and covering panels that can be detachably connected to each other in a very fast and easy manner so as to form a stand for display purpose, like those used in commercial display booths.

b) Brief Description of the Prior Art

Numerous display assemblies are known in the art and commonly used in the trade for temporary exhibitions, especially to display signs, placards or posters.

To make such display assemblies easier to transport, it has already been suggested in the art to make them from a plurality of hingedly connected light weight panels foldable onto each other. Examples of such lightweight and collapsible assemblies are disclosed in U.S. Pat. Nos. 4,657,149 of 1987; 4,912,866 of 1990 and 5,024,015 of 1991.

It has also been suggested to make display assemblies from a plurality of similar square frame units detachably connectable to each other in various patterns by mean of U-shaped clips, so as to form a vertical structure on which posters can be hung. An example of such a display assembly is disclosed in German laid-open patent application No. 2,035,718 published on Jan. 27, 1972. In this laid-open application, the assembled structure is supported on inverted T-shaped feet having uprights that pass through vertical holes made in the frame units.

It has further been suggested to use magnetic strips or bands to detachably fix a display sign or panel onto a supporting structure. In this connection, reference can be made to U.S. Pat. Nos. 3,965,599 of 1976; 3,987,567 of 1976 and German laid-open patent application No. 3,538,293 published on Apr. 30, 1987.

OBJECT AND SUMMARY OF THE INVENTION

The object of the present invention is to provide a very simple yet efficient and versatile display assembly made of a minimum number of lightweight modular units that are easy to store, transport and assemble.

More particularly, the object of the invention is to provide a modular display assembly of the above type, which has the following advantages:

- it is easy to assemble;
- it is collapsible into substantially flat items for space-saving storage and cheaper transport;
- it is lightweight;
- it can be arranged in a variety of ways;
- it is made of concealed structural profile members acting as a support for covering panels that may be printed with full surface graphics; and
- it can incorporate one or more load-bearing tables.

In accordance with the invention, this object is achieved with a modular display assembly comprising, in combination:

a) at least one lower frame unit made of structural profile members connected to each other so as to form a lower front panel of a given length and a pair of lower side panels having upper ends of a given width, the lower side panels being hingedly connected to the lower front panel on both sides thereof, respectively, so as to be pivotally movable between a folded position where they extend flat against the lower front panel and an unfolded position where they extend rearwardly in a direction perpendicular to the lower front panel;

b) at least one upper frame unit made of structural profile members similar to those of the lower frame unit and connected to each other in the same way so as to form an upper front panel of the same length as the lower front panel and a pair of upper side panels having lower ends of the same given width as the upper ends of the lower side panels, the upper side panels being hingedly connected to the lower front panel on both sides thereof, respectively, so as to be pivotable moveable between a folded position where they extend flat against the upper front panel and an unfolded position where they extend rearwardly in a direction perpendicular to the upper front panel;

c) connecting means preferably in the form of rods insertable into channels made in the profile members, for detachably connecting the upper frame unit on top of the lower frame unit, with the upper front and side panels extending in the same planes as the lower front and side panels, respectively;

d) a plurality of covering panels sized to cover the upper and lower front and side panels of the upper and lower frame units; and e) fixation means for detachably fixing the covering panels externally onto the respective upper and lower, front and side panels.

Preferably, the fixation means (e) consist of a first set of magnetic strips of a given polarity externally fixed to the profile members of the upper and lower, front and side panels, and of a second set of magnetic strips of an opposite polarity rearwardly fixed onto each covering panels so as to face the strips of the first set.

As can be appreciated, the modular display assembly according to the invention is made of self-supporting frame units that are very simple in structure and collapsible, for easy transport. These frame units can be assembled in a very simple manner, with no tool. Once assembled, the covering panels which can be made of any required material and bear any kind of display printed in a factory, can be detachably affixed to the structure to complete the same.

If desired, one or more lamps may also be provided, as will be described hereinafter.

BRIEF DESCRIPTION OF THE DRAWINGS

The invention and its numerous advantages will be better understood upon reading of the following, non-restrictive description of a preferred embodiment thereof, given with reference to the accompanying drawings in which:

FIG. 10 is a perspective view of part of two frame units superimposed in each other, said view also showing a connector rod for use to connect these two units together, in a position adjacent the endmost meeting edges of the two frame units;

FIG. 10*a* is a lateral elevational view of the two meeting edges of the frame units of FIG. 10;

FIG. 10*b* is a front elevational view of the edges shown in FIG. 10*a*;

DESCRIPTION OF A PREFERRED EMBODIMENT OF THE INVENTION

Figure 1:
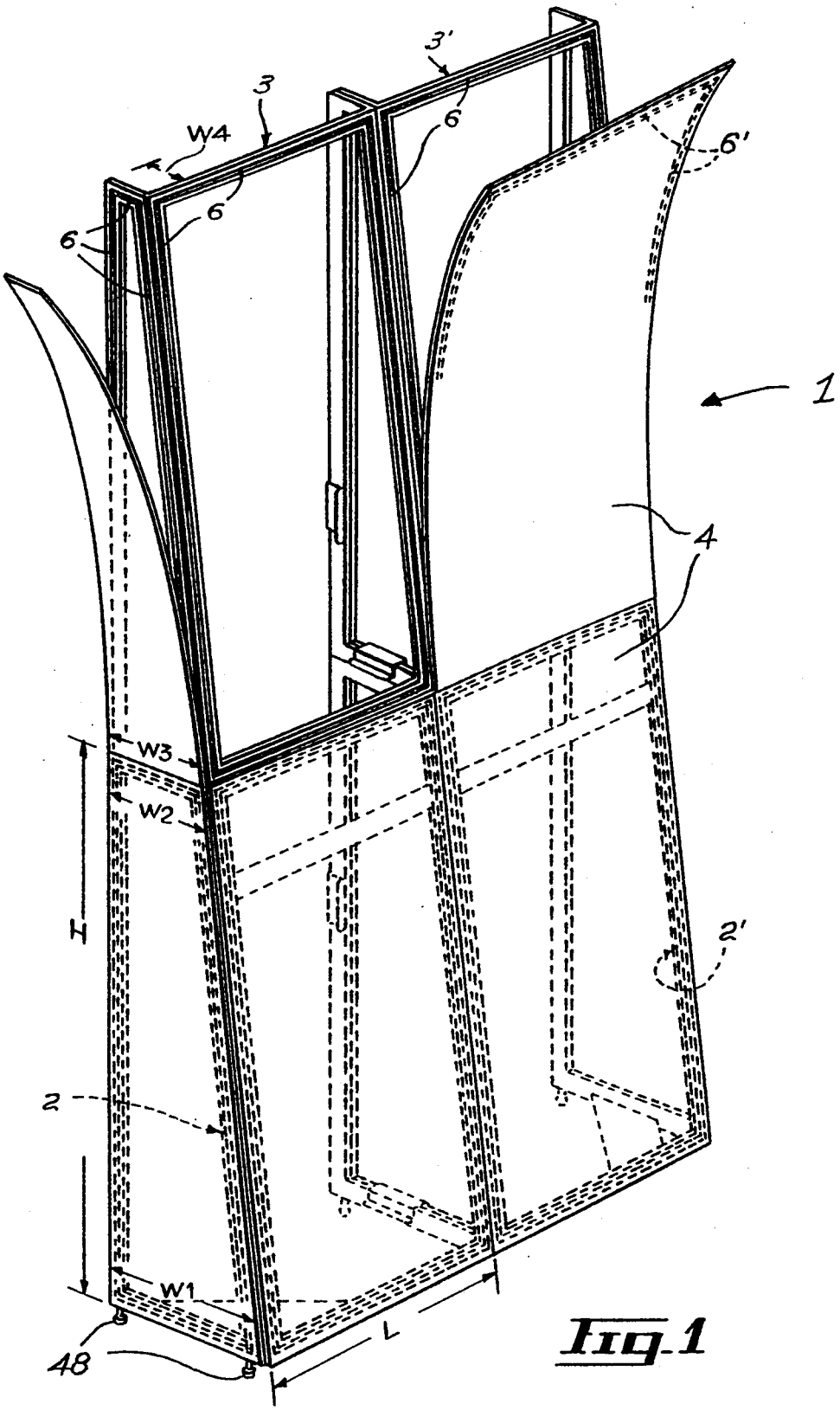
FIG. 1 is a perspective view of a modular display assembly according to the invention, consisting of frame units assembled to form a stand onto which flexible covering panels are mounted, only some of said panels being shown.
Figure 2:
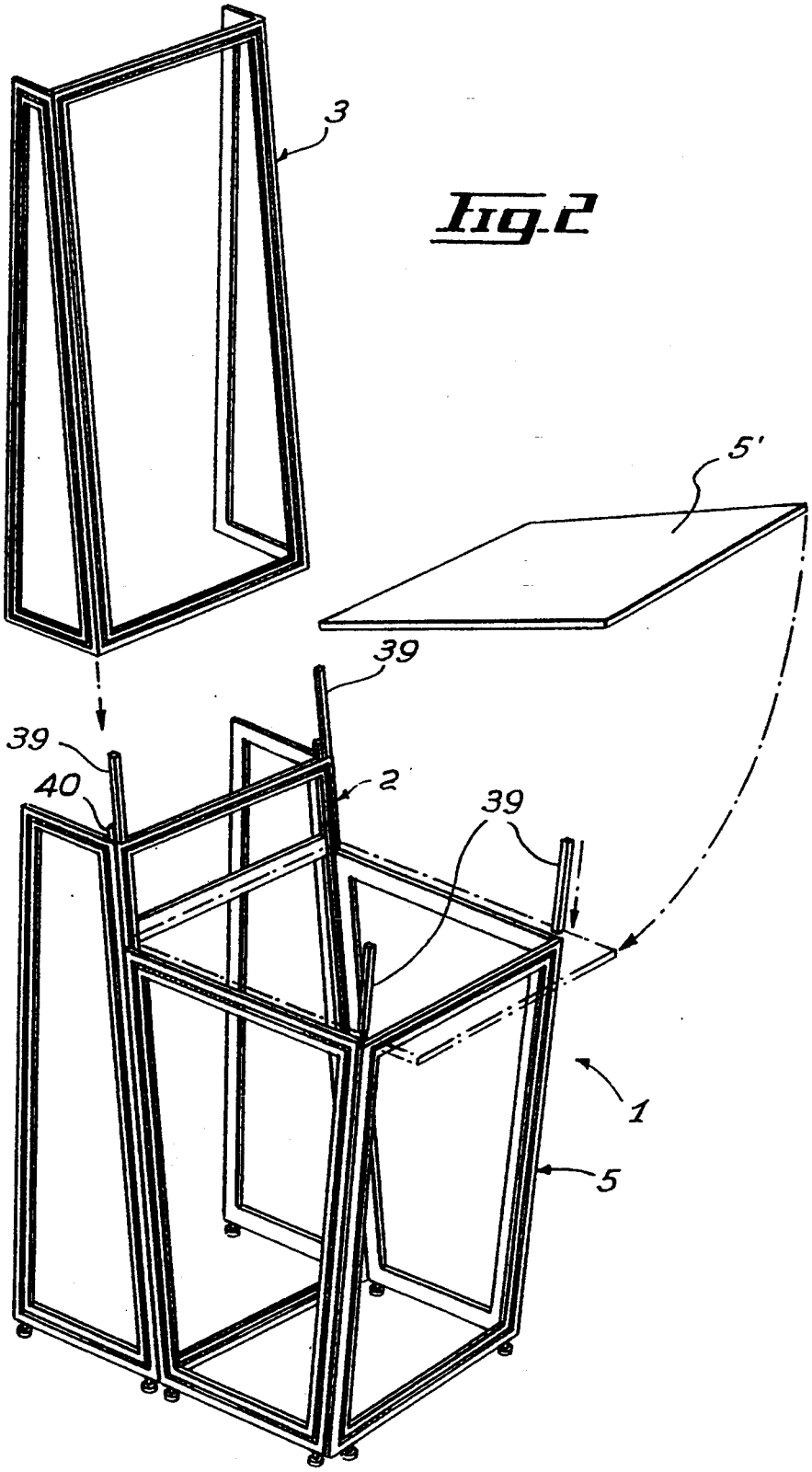
FIG. 2 is an exploded perspective view of another modular display assembly in the form of a stand incorporating table.

The modular display assembly 1, according to the invention as shown in FIG. 1 of the drawing is made of a first set of lower frame units 2, 2', and a second set of upper frame units 3, 3', . . . , connectable to each other so as to form a vertical stand on which the display or covering panels 4 preferably made of flexible or semi-flexible material can be affixed. In addition to the frame units 2, 2', . . . and 3, 3', . . . , the assembly may also comprise one or more table-defining units 5 connectable to one or more of the units 2, 2', . . . , each unit 5 being provided with a table top 5', as is shown in FIG. 2.

Figure 7:
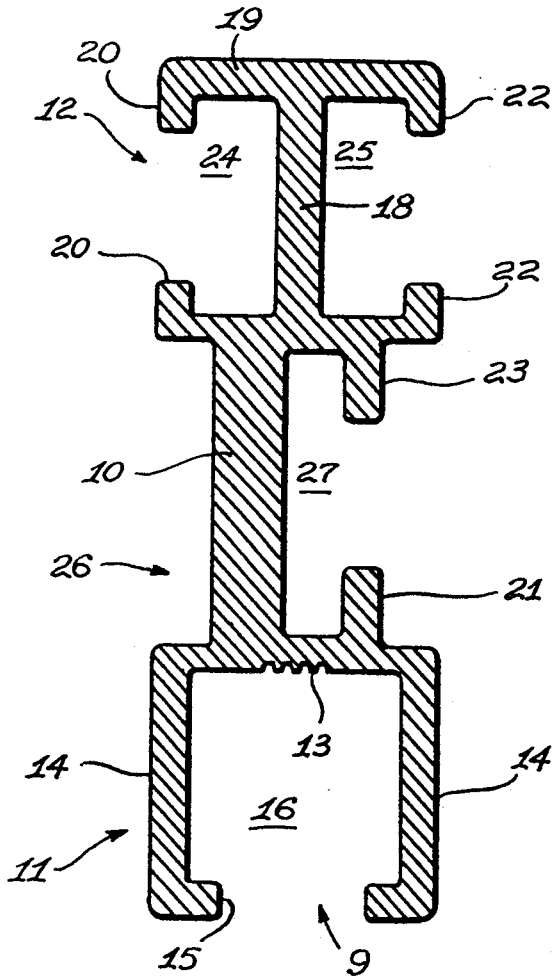
FIG. 7 is a cross-sectional view of the structural profile member used to construct each unit.
Figure 8:
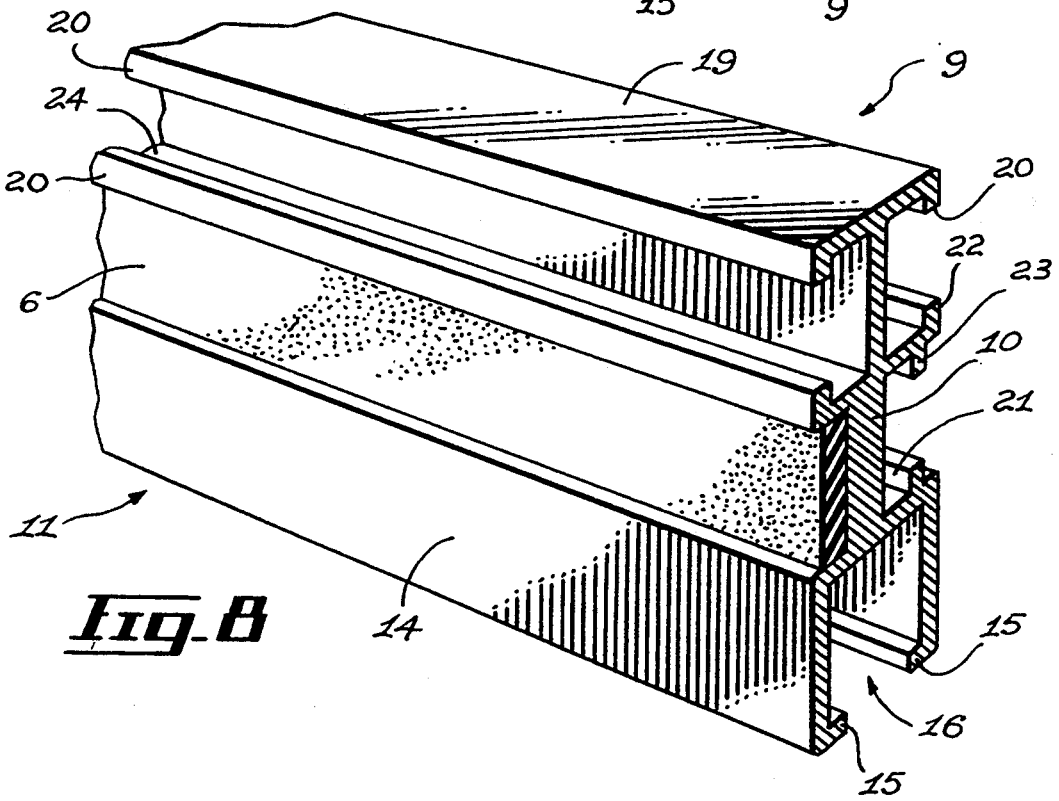
FIG. 8 is a perspective view of a length of the structural profile member of FIG. 7, incorporating a magnetic strip on one of its sides.

Each of the frame units and table-defining units are made of a plurality of structural profile members 9, best shown in FIGS. 7 and 8, which are connected to each other so as to firm a rectangular front panel and a pair of trapezoidal side panels hingedly connected to the vertical sides of the front panel as will be described hereinafter.

The profile members 9 are preferably made of extruded rigid, lightweight material such as aluminum, eventhough they could also be made of any other rigid material such as strong plastic material. Each profile member 9 is shaped so as to define, when seen in cross-section, a flat rigid strip 10 having a first channel section 11 at one end and a second channel section 12 at the other end.

The first channel section 11 comprises an inner wall 13 transversal to the strip 10 and a pair of opposite side walls 14 that extend parallel to the strip 10 away from the same. Each side wall 14 has an inwardly projecting flange 15 along its outer edge. The flanges 15 face each other and constitute a first abutment means as will be explained. Thus the first channel-defining end 11 defines a lengthwise-box shaped extending channel 16 axially opened in the direction opposite to the strip 10.

The second channel-section 12 of the profile member 9 also comprises an inner wall 17 transversal to the strip 10. It her comprises a middle wall 18 extending parallel to the strip 10 away from the same substantially in the middle of the inner wall 17, and an outer wall 19 transversal to the middle wall 18. Second and third abutment means constituted by two pairs of facing flanges 20 and 22, are respectively provided at the respective ends of the walls 17, 19. Thus, the second channel section 12 defines a pair of opposite box-shaped side channels 24, 25.

As is shown in the drawings, the strip 10 is slightly offset with respect to the centerline or axis of the centerline of the member 9. On the wider side of the strip, there are a pair of spaced-apart and facing ledges 21, 23 forming a guideway 27. The other, narrower side of the strip 10 defines a rectangular groove 26, which, as best shown in FIG. 8, is adapted to receive a magnetic strip 6 of one polarity.

Figure 5:
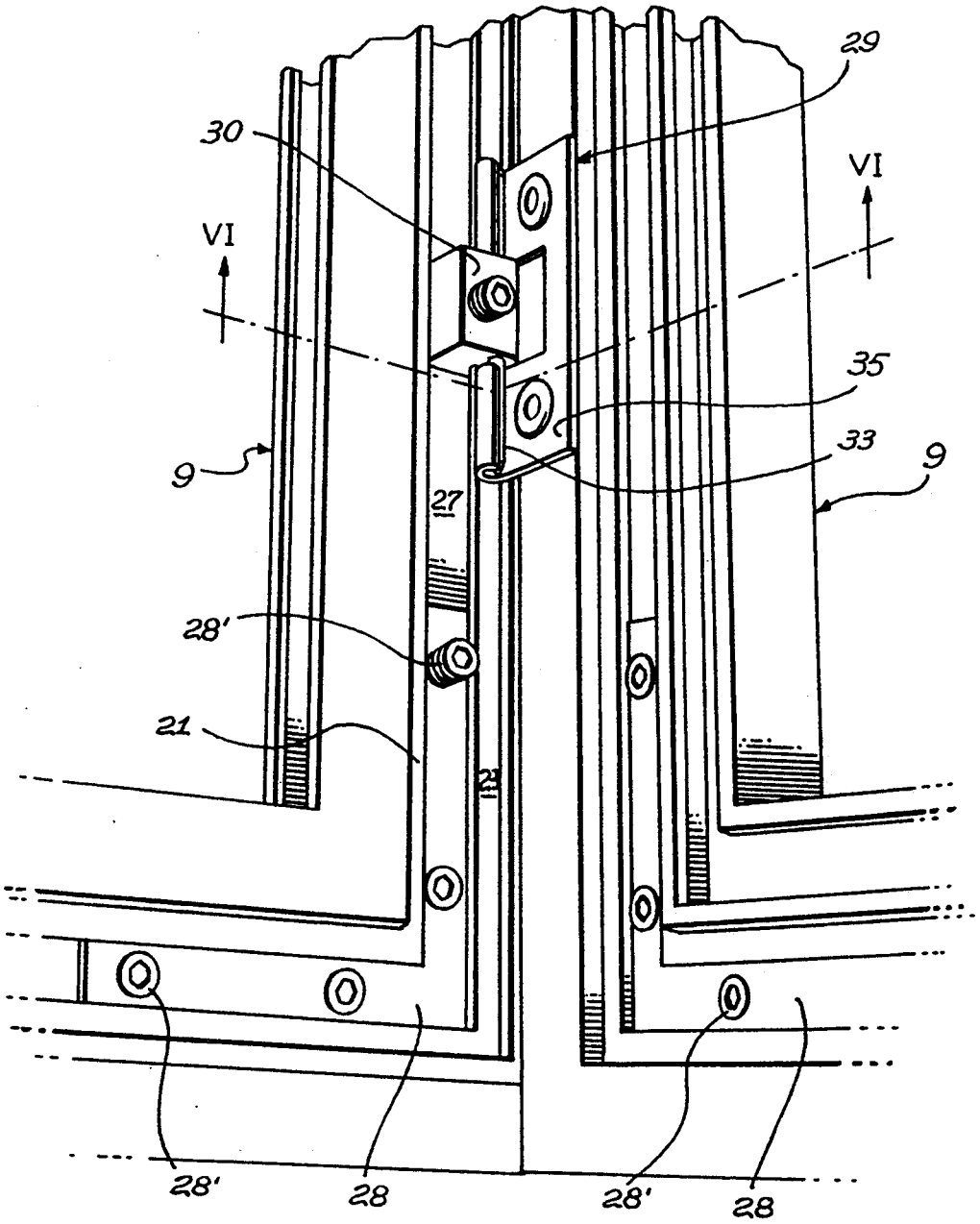
FIG. 5 is a perspective view of a portion of the front and side panels of the frame unit of FIGS. 4 and 5, showing the winged fasteners used for connecting the structural profile members of the unit together and the hinge means used for connecting the side panels to the front panel of this unit.

Attachment means are provided to connect to each other the profile members 9 disclosed hereinabove, so as to form the front rectangular panel and the two side panels of each frame unit. As is shown in FIGS. 5 and 10, these attachment means preferably consist of double-wing fasteners 28 similar to those used for assembling the profile members of commercially available, aluminium frames like those used to display art painting or posters. Each fastener 28 consists of a flat L-shaped member made of metal, which comprises two "wings" at the required angle (which is 90° in the case of the front panel). One or two threaded bores are provided in each wing for receiving Allen screws 28'. The fastener 28 fits into the guideways 27 at the respective ends of each pair of profile members 9 to be connected to each other. Of course, the ends of the profile members 9 must previously be cut at an angle as is shown, so as to match and define the requested frame corner. Tightening of the Allen screws push the fastener against the ledges 21, and thus secures the adjacent profile members 9, thereby defining a corner of the frame. If the profile members are cut at 45° and the wings are at 90° the corner will be at a right angle. To form the trapezoidal side panels of each frame unit, fasteners with wings at an angle higher or lower than 90° will be needed, and the profile members will have to be cut accordingly. This method of assembly is very standard and needs not be further disclosed.

Figure 6:
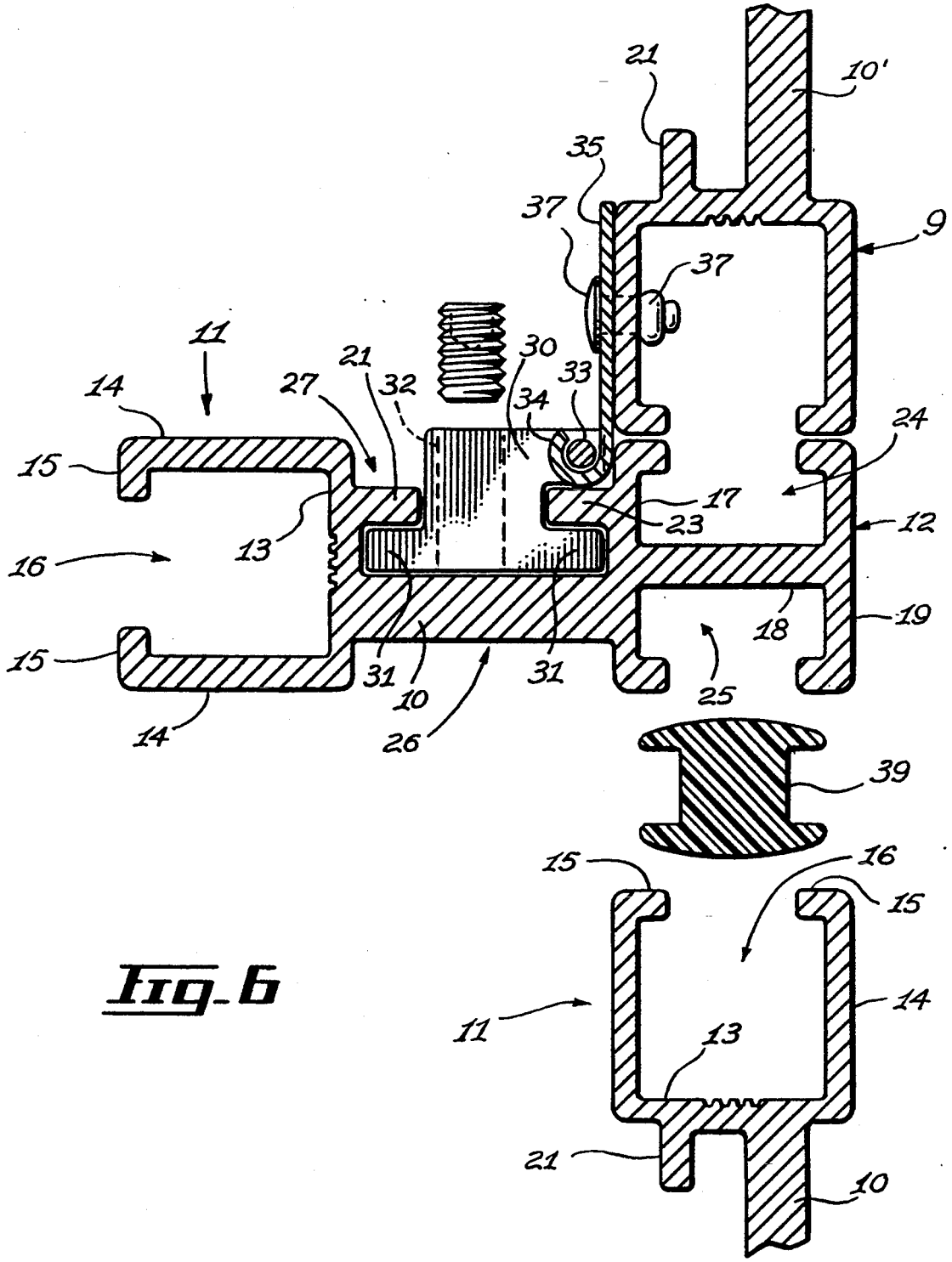
FIG. 6 is a cross-sectional view taken along lines VI—VI of FIG. 5.

Once the front and side frame panels of each frame unit have been assembled, they need to be hingedly connected to each other. For this purpose, hinge means 29 are provided which are best seen in FIGS. 5 and 6. These hinge means 29 include a block.30 having a pair of laterally extending shoulders 31 sized to slidably fit into the guideway 27 under the edges 21, 23 thereof. The block 30 has a threaded hole 32 adapted to receive an Allen screw (not shown) so as to fix it in position along the guideway 27 of, say, one of the profile members acting as a vertical side of the front frame panel, and a lengthwise-extending bore through which a pivot pin 33 can be inserted in such a manner as to project from both sides of the block 30 in a direction parallel to the guideway 27 when the block is slid into this guideway. The hinge means 29 also comprise a pivot plate 35 having a U-shaped edge portion with a pair of spaced apart ends 34 rolled into tubes on both sides of a central cutout portion. The plate 35 is secured by rivets or screws 37 to the profile member 9 of the side panel that is adjacent to the profile member of the front panel in which the block 30 is secured. In use, the tube-shaped ends 34 of the plate are positioned in registry with the bore in the block and the pivot pin 34 is inserted so as to pass through al of them to pivotally connect the plate 35 to the block 30 and thus the adjacent profile members to each other.

As can be appreciated, one may use as much hinging means as necessary on each side of the rectangular front panel to connect the adjacent trapezoidal side panel. Two or three of such hinging means will usually be sufficient.

As can also be appreciated, the block 30 of the hinging means 29 could also be slid into the guideway of the profile member of the side panel while the plate 35 is secured to the front frame panel (i.e. in positions contrary to what was disclosed above)

Similarly, it can be appreciated that hinging means of different structure but having the same function could be used in the place of those previously described.

Figure 3:
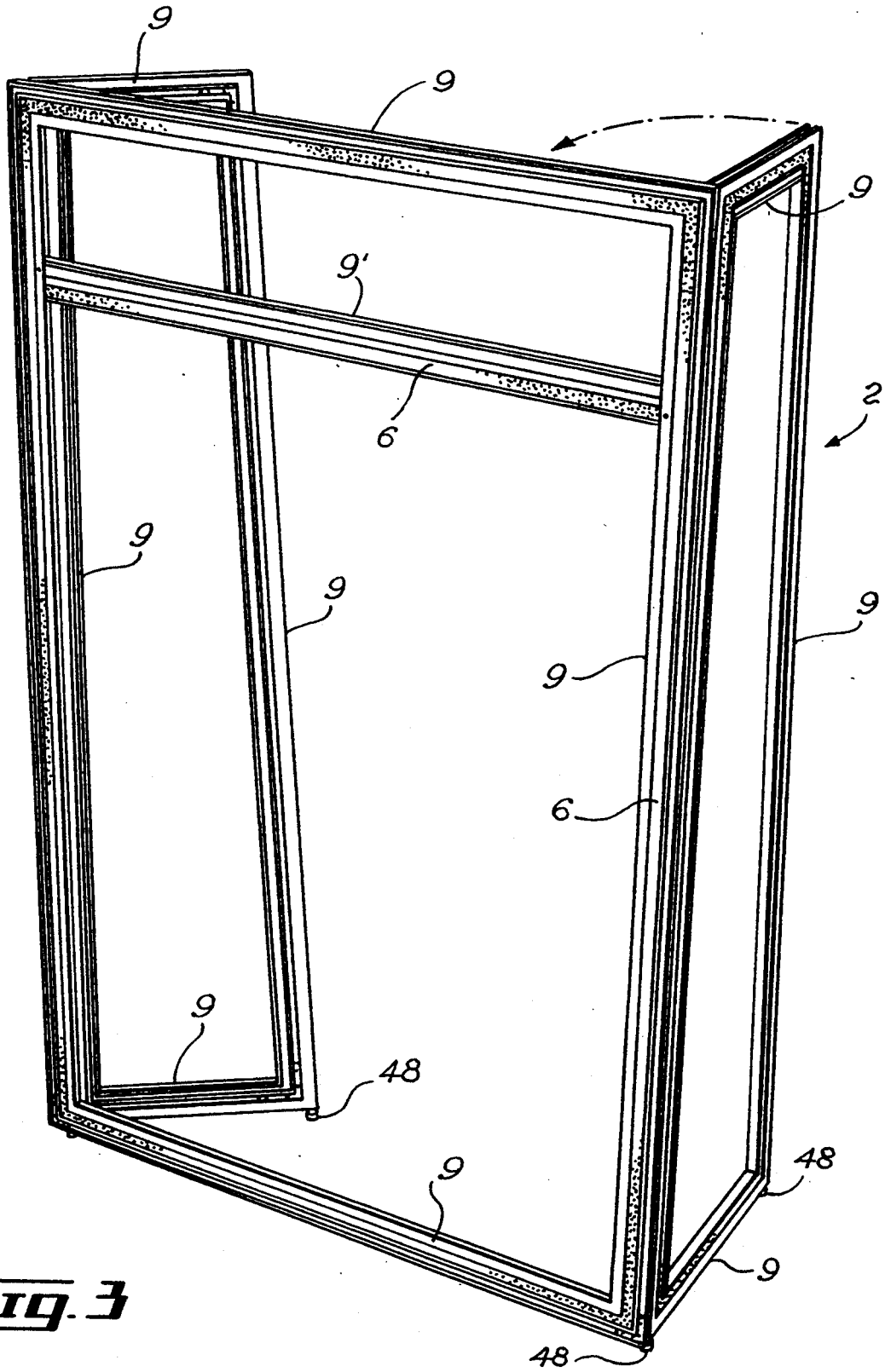
FIG. 3 is a perspective view of one of the frame units used in the assembly according to the invention, said unit having two hinged side panels in semi-opened position.
Figure 4:
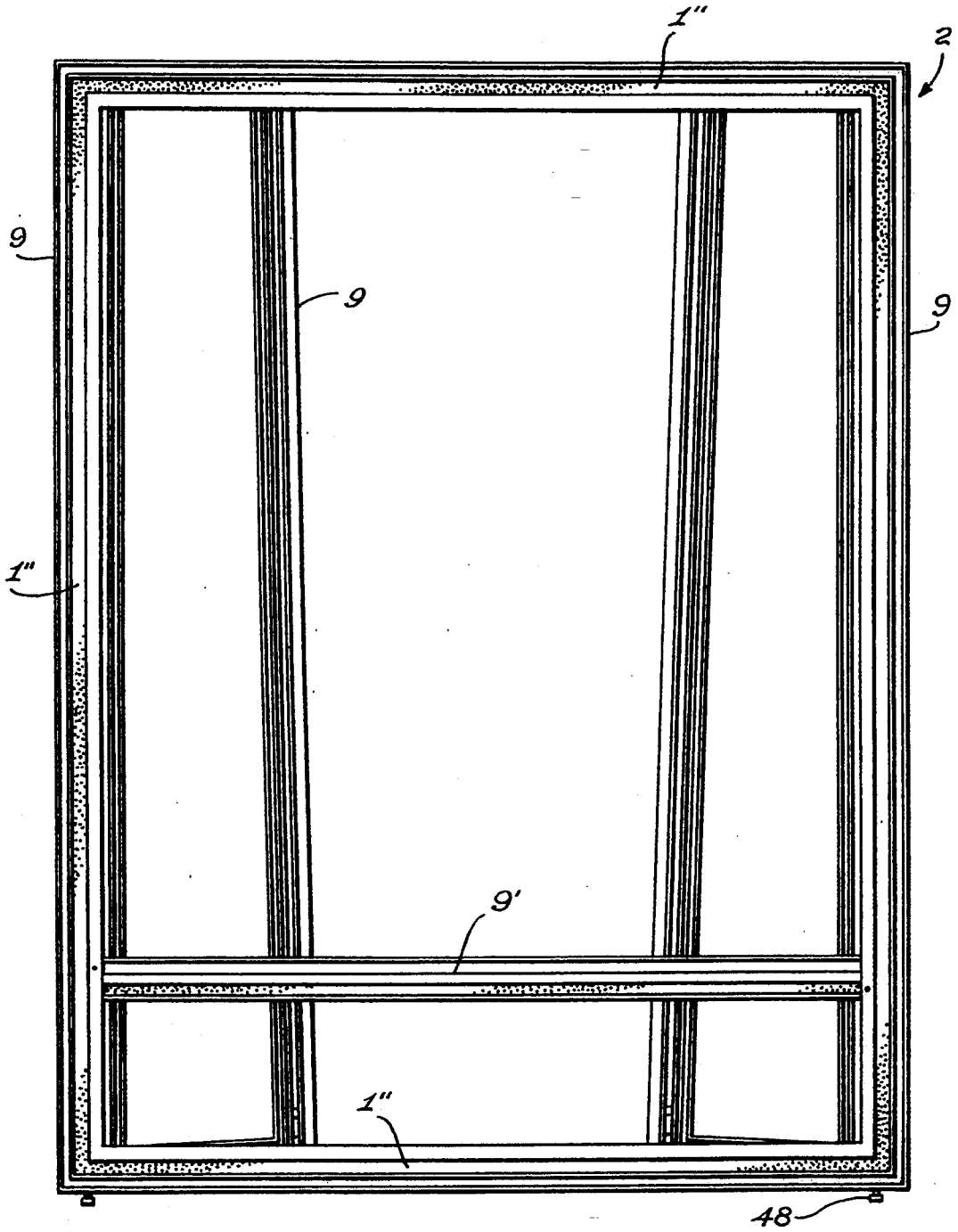
FIG. 4 is a front elevational view of the frame unit shown in FIG. 4, showing the two hinged side panels in folded condition.
Figure 12:
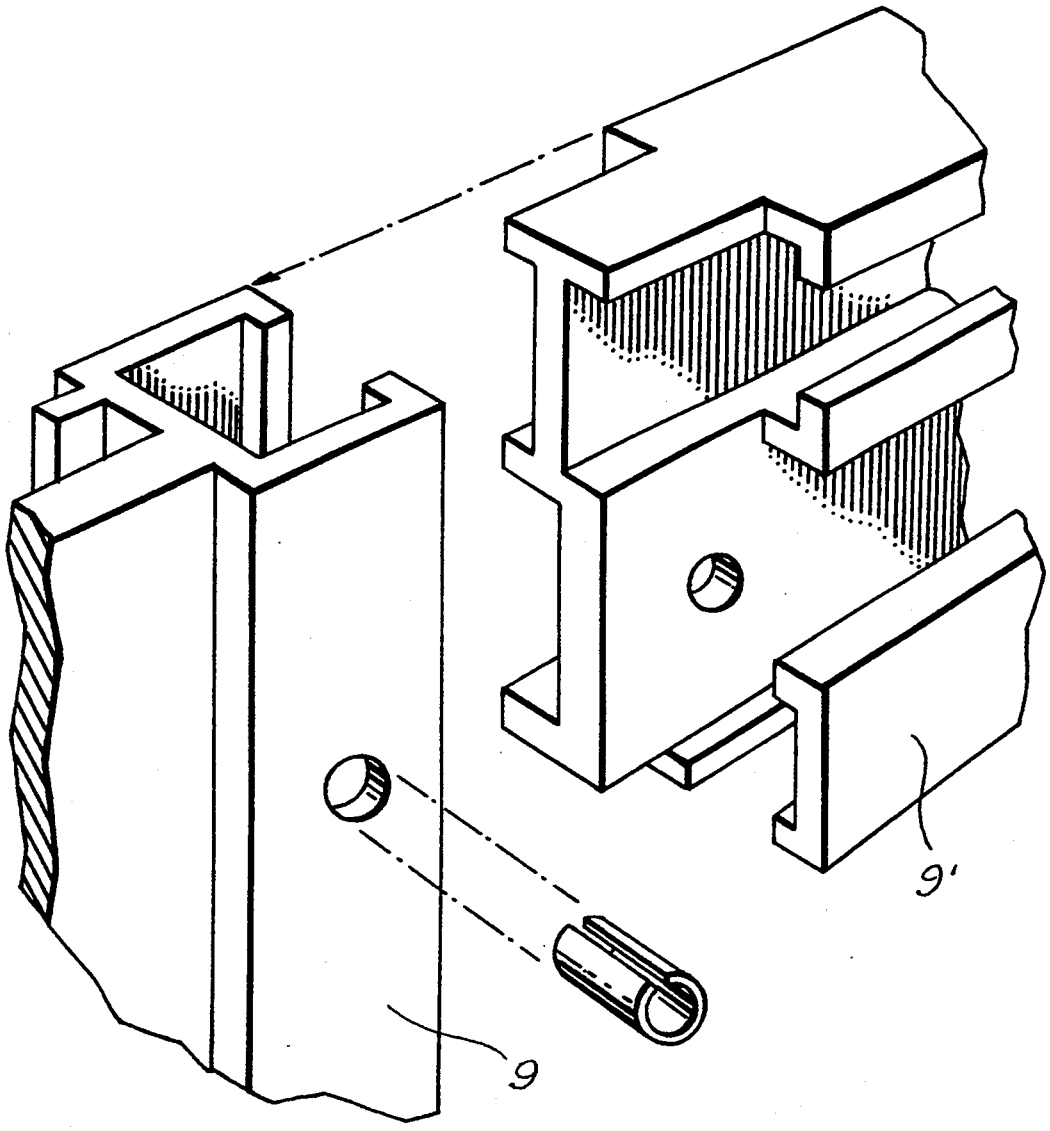
FIG. 12 is an exploded view showing the interconnection between a vertical profile member and the adjacent end of a cross-member when such is used.

As is better shown in FIG. 3, the profile members forming the front, and side panels of each frame unit are assembled so that their magnetic strips 6 can be externally positioned when the frame is in an unfolded position. If desired, one or more of the frame panels, especially the front one, may also be provided with one or more cross-members 9' which my consists of lengths of the profile member 9 previously described, attached by means of compression pins to the vertical sides of the corresponding panel, as is shown in FIG. 12.

Referring back to FIGS. 1 and 2, one can see that the lower frame units 2, 2', . . . of the first set are identical in size and each provided with levelling means 48 of conventional structure at their bottoms. They preferably have a height H of 47", a length L of 29½", a lower width "$w_1$" of 12" and an upper width "$w_2$" of 4¼". The upper frame unit 3,3'. . . of the second set are also identical in size and preferably have the same height H as the frame unit of the first set. Their length must be identical to the length L of the lower front panel while their lower width "$w_3$" is equal to "$w_2$". In the exemplified embodiment, the upper width "$w_4$" side panel of the upper is equal to 3½". As a result, when a lower frame unit 2 is connected to an upper frame unit 3 as is shown in the drawings, the lower and upper front panels extend in a same plane that is slightly inclined upwardly rearwardly with respect to the vertical.

To connect the upper frame unit 3 on top of the lower frame unit 2, connecting means are provided, which consist of a plurality of connector rods 39 best shown in FIGS. 10, 10*a* and 10*b*. Each rod 39 is of generally H-shaped cross-section and comprises two opposite rectangular channels 39'. FIG. 10 clearly shows how the rod 39 may be inserted to lock together the adjacent profile members of the side panels of two vertically stacked frame units 2 and 3. To allow insertion of said rod 39 into the profile members, a notch 49 can be made in the flange 15 of the profile member 9 on top of the side panel of the lower frame unit 2 while another notch 50 is made in the profile member 9 at the bottom of the adjacent side panel of the upper unit 3. The two channels 39' fit precisely around the flanges 15 of both frame members. FIG. 2 shows how the same kind of rod 39 can be used to fasten the vertical profile members at the rear of the table-defining unit 5 to the profile members on both sides of the front panel of a bottom frame unit 2. In such a case, the rod 39 is slid into the channel 25 of the front profile members and into the channel 16 of the rear profile member, as is shown in exploded view in FIG. 6. Obviously, the rod 39 can be pre-cut to any required length.

To facilitate the assembly and prevent the upper frame unit 3 from sliding back and forth relative to the lower one, the connecting means may also comprise locking pins 40' which are inserted into one of the aligned channels 24 and 25 of the vertical profile members (see FIG. 2) of the upper and lower frame units, which are in line.

Figure 9:
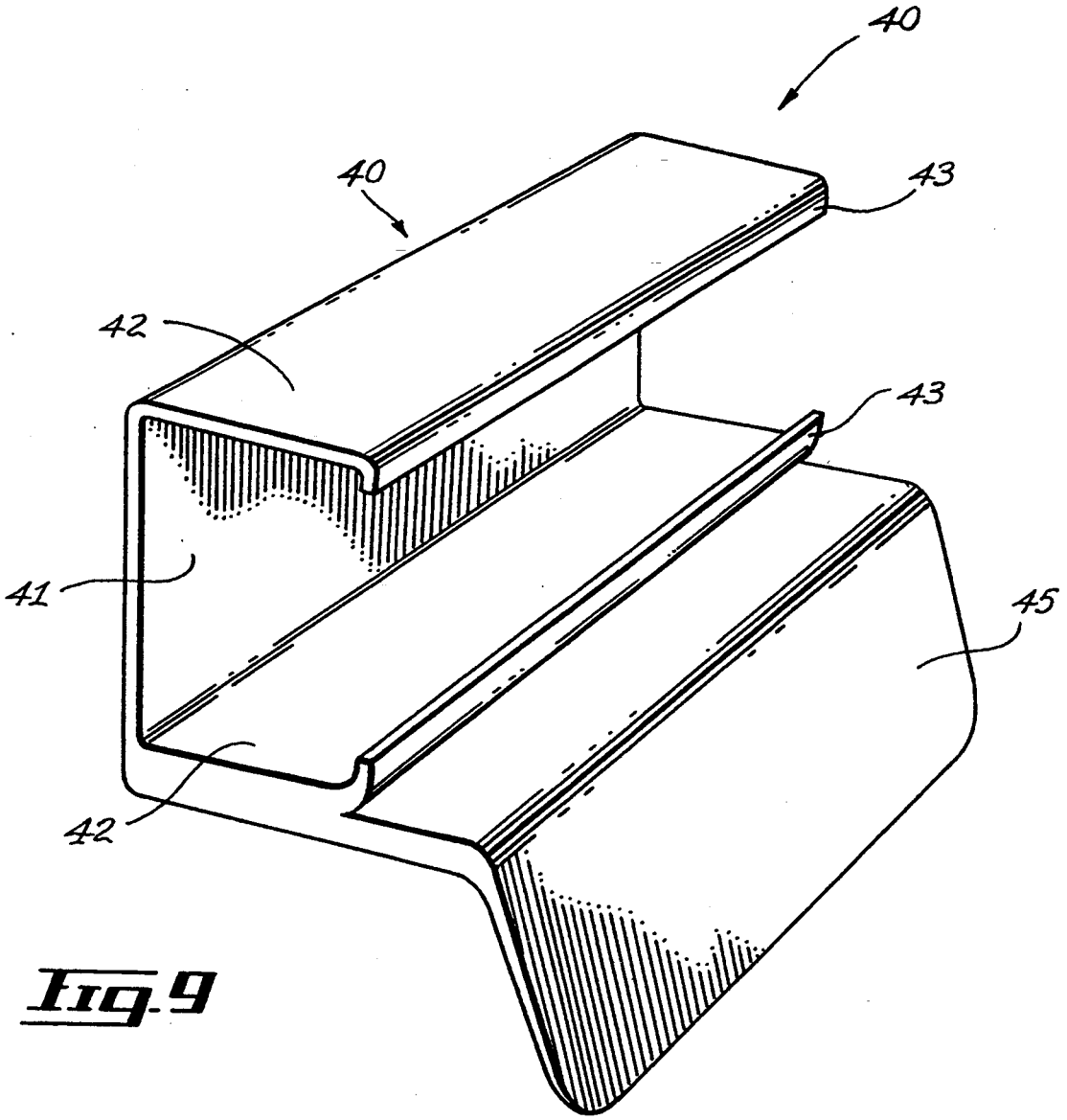
FIG. 9 is a perspective view of a clip that can be used to connect adjacent frame units to each other.
Figure 11:
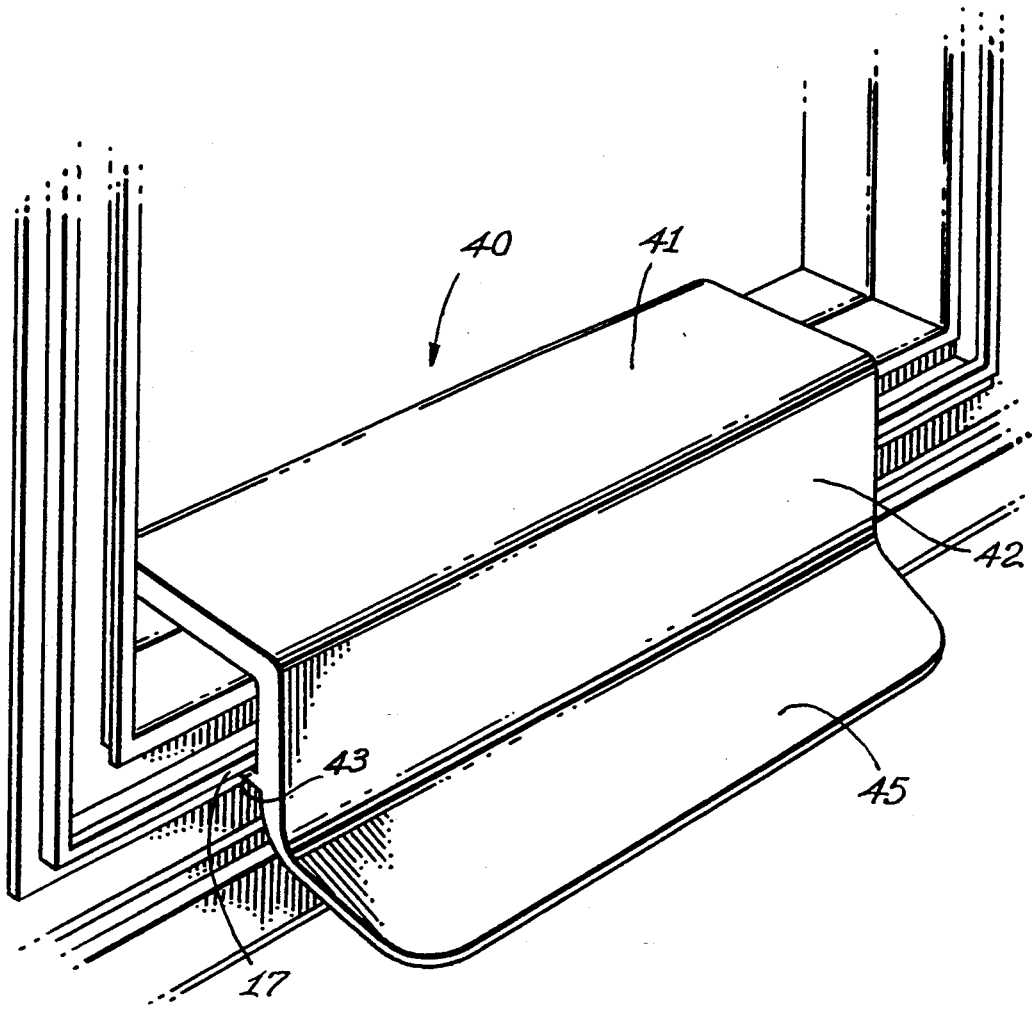
FIG. 11 is a perspective view of a section of two coextending frame units secured by a clip as shown in FIG. 9.

To connect to each other laterally adjacent frame units or stands formed from such units, fixation means are provided. As is shown in FIGS. 9 and 11, the fixation means preferably consist of straddle clips 40 each having a flat base 41 and a pair of upstanding sides 42, the latter being provided with edge beads 43. One of the sides of the clip 40 is formed with a large tab 45. The tab 45 is used to provide leverage to snap on the clip or remove the same from two adjacent profile member 9, as seen in FIG. 11. When the clip is snapped, its beads 43 engage the respective inner walls 17 of the adjacent profile members 9.

As can be appreciated, the frame units 2, 2', . . . 3,3', . . . and 5 of the display assembly according to the invention are very light and simple in structure. They are made of lightweight profile members easy to assemble and form into panels devised in such a manner as to be foldable, thereby reducing the space, needed for transport. Each stand can be very easily assembled on premises, without tools. If desired, one or more table-defining units 5 of substantially the same structure as the frame units 2 may be used. After the stand and the optional table have been assembled, the display assembly may be completed by positioning the table top 5' onto the framing of table-defining unit 5 and affixing the covering panel 4 onto each outer from and side panels. For this purpose, magnetic strips 6' of polarity opposite to the one of the strips 6 (shown in dotted line in FIG. 1) can be secured to the reverse side of each panel so as to correspond to and face each of the trips 6. As a result, the covering panels may be easily installed, removed and interchanged.

Figure 13:
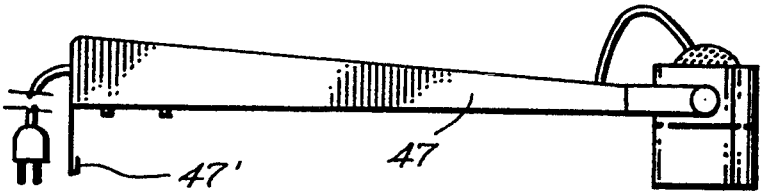
FIG. 13 is a side elevational view of a lamp adapted for use with the modular display unit according to the invention.

To complete the assembly, one or more lamps 47 preferably of the halogen type, can be provided and clipped onto any horizontal upper profile member of the frame unite 3, 3' by means of a hook element 47' (see FIGS. 1 and 13).

I claim:

1. A modular display assembly comprising, in combination:

a) at least one lower frame unit made of structural profile members connected to each other so as to form a lower front panel of a given length and a pair of lower side panels having upper ends of a given width, said lower side panels being hingedly connected to the lower front panel on both sides thereof, respectively, so as to be pivotally movable between a folded position where they extend flat against the lower front panel and an unfolded position where they extend rearwardly in a direction perpendicular to the lower front panel;

b) at least one upper frame unit made of structural profile members similar to those of the lower frame unit and connected to each other in the same way so as to form an upper front panel of the same length as the lower front panel and a pair of upper side panels having lower ends of the same given width as the upper ends of the lower side panels, said upper side panels being hingedly connected to the lower front panel on both sides thereof, respectively, so as to be pivotally moveable between a folded position where they extend flat against the upper front panel and an unfolded position where they extend rearwardly in a direction perpendicular to the upper front panel;

c) connecting means for detachably connecting the upper frame unit on top of the lower frame unit with the upper front and side panels extending in the same planes as the lower front and side panels, respectively;

d) a plurality of covering panels sized to cover the upper and lower front and side panels of the upper and lower frame units; and e) fixation means for detachably fixing the covering panels externally onto the respective upper and lower, front and side panels.

2. The display assembly of claim 1, wherein the fixation means (e) consists of a first set of magnetic strips of a given polarity externally fixed to the profile members of the upper and lower, front and side panels, and of a second set of magnetic strips of an opposite polarity rearwardly fixed onto each covering panels so as to face the strips of the first set.

3. The display assembly of claim 2, wherein:

each of said structural profile members is made of extruded, rigid lightweight material and is shaped to define a flat strip having a first end and a second end;

a first channel section at said first end, comprising a first inner wall transversal to the strip and a pair of parallel side walls defining together a box-shaped channel axially opened in a direction opposite to the strip, each of said parallel side walls having an outer end with an inwardly projecting flange, said flanges defining together a first abutment means; and a second channel section at said second end, comprising a second transverse inner wall, a middle wall extending parallel to said flat strip away from the same, a transverse outer wall and two pairs of facing flanges respectively provided on said inner and outer walls, said flanges constituting second and third abutment means and defining with the adjacent walls, a pair of opposite box-shaped side channels, respectively;

the flat strip in between said first and second inner walls defining a central guideway on one side, incorporating a pair of facing ledges, and a rectangular groove on the other side thereof;

the structural profile members forming each of said upper and lower front and side panels are connected end to end to each other by means of double wing fasteners slid and fixed into their respective central guideways; and the connecting means (c) comprises H-shaped connector rods slidably insertable into the abutting first channel sections of each other of each pair of adjacent profile members.

4. The display assembly of claim 3 wherein each of said double-wing fasteners comprises a pair of wings at an angle;

at least one threaded bore in each of said wing; and a tightening screw in each bore;

said wings of said fastener being slid into the guideways of adjacent structural profile member and set in place by its tightening screws, thereby allowing proper connection of said profile members to form a corner.

5. The display assembly of claim 4, wherein each side panel is hingedly connected to the corresponding front panel by means of at least two hinging means each comprising:

a block having a pair of laterally extending shoulders adapted to engage and be fixed into the guideway of a vertical profile member of one of said side and front panels said block also having a threaded hole adapted to receive a tightening screw and a lengthwise extending bore:

a pivot plate fixed to the adjacent profile member of the other one of said side and front panels said plate having an edge with a pair of opposite ends and a central cut-out portion sized and positioned to fit over the block when the panels are in folded condition, said opposite ends of the edge of said pivot plate being formed into tubes positioned in registry with said bore; and a pivot pin engageable in said tubes and the bore for pivotally connecting the same.

6. The display assembly of claim 5, comprising at least two of said lower frame units and two of said upper frame units, each one of said lower frame units being connected to one of said upper frame units, and wherein said assembly further comprises:

(f) at least one straddle clip having a flat base, a pair of upstanding sides each provided with edge beads, and a large tab projecting from one of said upstanding sides, said clip being sized to fit onto and fasten two coextending parallel profile members of similar frame units adjacent to each other so as to join the same laterally.

7. The display assembly of claim 6, wherein the side panels of each upper and lower frame units are trapezoidal in shape and sized so that, when the lower frame unit is connected to the upper frame unit, the lower and upper front panels thereof extend in a same plane that is slightly inclined upwardly rearwardly with respect to the vertical.

8. The display assembly of claim 7, further comprising:

(g) at least one table frame unit made of structural profile members similar to those of the upper and lower frame units and connected to the other in the same way, said table frame unit having a front and a pair of lateral sides;

(h) additional connecting means for detachably connecting said table frame unit to the lower frame unit;

(i) additional covering panels sized to cover the front and lateral sides of said table frame unit; and (j) a table top detachably fixable on top of said table frame unit.

9. The display assembly of claim 7, further comprising:

(k) at least one lamp hookable on top of said upper frame unit.

10. The display assembly of claim 2, comprising at least two of said lower frame units and two of said upper frame units, each one of said lower frame units being connected to one of said upper frame units, and wherein said assembly further comprises:

(f) at least one straddle clip having a flat base, a pair of upstanding sides each provided with edge beads, and a large tab projecting from one of said upstanding sides, said clip being sized to fit onto and fasten two coextending parallel profile members of similar frame units adjacent to each other so as to join the same laterally.

11. The display assembly of claim 2, wherein the side panels of each upper and lower frame units are trapezoidal in shape and sized so that, when the lower frame unit is connected to the upper frame unit, the lower and upper front panels thereof extend in a same plane that is slightly inclined upwardly rearwardly with respect to the vertical.

12. The display assembly of claim 2, further comprising:

(g) at least one table frame unit made of structural profile members similar to those of the upper and lower frame units and connected to the other in the same way, said table frame unit having a front and a pair of lateral sides;

(h) additional connecting means for detachably connecting said table frame unit to the lower frame unit;

(i) additional covering panels sized to cover the front and lateral sides of said table frame unit; and (j) a table top detachably fixable on top of said table frame unit.

13. The display assembly of claim 2, further comprising:

(k) at least one lamp hookable on top of said upper frame unit.

14. The display assembly of claim 6, further comprising:

(k) at least one lamp hookable on top of said upper frame unit.

15. The display assembly of claim 7, further comprising:

(k) at least one lamp hookable on top of said upper frame unit.

* * * * *